US006651960B1

(12) United States Patent
Koester

(10) Patent No.: US 6,651,960 B1
(45) Date of Patent: Nov. 25, 2003

(54) WINCH ASSEMBLY FOR TRUCK RECEIVER BOX

(76) Inventor: Richard L. Koester, 1231 Medfra St., Anchorage, AK (US) 99501

( * ) Notice: Subject to any disclaimer, the term of this patent is extended or adjusted under 35 U.S.C. 154(b) by 0 days.

(21) Appl. No.: 10/134,154

(22) Filed: Apr. 26, 2002

(51) Int. Cl.[7] ..... B66D 1/36
(52) U.S. Cl. ..... 254/325
(58) Field of Search ..... 254/323, 325, 254/294, 251, 31, 30, 132, 4 R, 4 B, 4 C

(56) References Cited

U.S. PATENT DOCUMENTS

| | | | | | |
|---|---|---|---|---|---|
| 347,721 | A | * | 8/1886 | Krause | 172/680 |
| 3,718,317 | A | * | 2/1973 | Hilmer | 254/342 |
| 3,797,681 | A | * | 3/1974 | Brettrager | 414/559 |
| 3,991,977 | A | * | 11/1976 | Penttila | 254/264 |
| 4,807,899 | A | * | 2/1989 | Belcher | 280/477 |
| 5,192,052 | A | * | 3/1993 | Abarotin | 254/30 |
| 5,224,687 | A | * | 7/1993 | Geckler et al. | 254/30 |
| 5,593,139 | A | * | 1/1997 | Julian | 254/325 |
| 5,697,597 | A | * | 12/1997 | Goodbold | 254/4 B |
| 5,913,507 | A | * | 6/1999 | Lauricella, Jr. | 254/325 |
| 5,967,732 | A | * | 10/1999 | Floyd | 414/462 |
| 6,138,992 | A | * | 10/2000 | Bell | 254/326 |
| 6,386,514 | B1 | * | 5/2002 | Ray | 254/323 |

* cited by examiner

*Primary Examiner*—Kathy Matecki
*Assistant Examiner*—Evan Langdon
(74) *Attorney, Agent, or Firm*—Michael J. Tavella

(57) ABSTRACT

A frame assembly that fits into the hitch receiver box found on many trucks.

It has reinforced vertical plate attached to the outer end of an accessory tube. The vertical plate has a series of lugs attached to the top sides of the plate. A pulley is mounted below the lugs. The lugs hold the bottom of a standard car jack, which has a lift plate and is operated by a handle. Wire rope is attached to an eye in the lift plate. The wire rope passes around the pulley. The winch works by placing a jack in the lugs and attaching the wire rope to the eye. The other end of the wire rope is secured to an anchor chain that is secured to a substantial object, such as a tree. As the jack is operated, it pulls on the wire rope, which moves a vehicle.

16 Claims, 3 Drawing Sheets

WINCH ASSEMBLY FOR TRUCK RECEIVER BOX

CROSS REFERENCE TO RELATED APPLICATIONS

Not Applicable

STATEMENT REGARDING FEDERALLY SPONSORED RESEARCH AND DEVELOPEMENT

Not Applicable

BACKGROUND OF THE INVENTION

1. Field of the Invention

This invention relates to winch assemblies and particularly to winch assemblies for truck receiver boxes.

2. Description of the Prior Art

Winches have been used on trucks for many years to move heavy objects, and to pull the truck out of a bad spot, such as being stuck in mud or snow. In these types of operations, the winch cable is anchored to a tree or other support and the cable is then retrieved. As the cable is being pulled back into the winch, the vehicle is pulled toward the anchor spot. Once the vehicle is clear of the problem area, the cable can be unhooked from the anchor and stored. The vehicle can then move freely. One main problem exists with this tool. If the vehicle is in a position in which pulling on a winch cable makes things worse, then the winch has very little value. For example, if a vehicle with a winch on the front slides into a ditch front first, pulling on the winch cable will pull the vehicle farther into the ditch.

There have been some devices developed to help change the direction of pull of these winches. These devices can, for example reverse the pull on the vehicle in the example mentioned above so that the winch will pull the vehicle backwards. Examples of these devices are found in the following U.S. Patents. U.S. Pat. No. 3,991,977 to Penttila discloses a vehicle jack that can be used for towing. The device uses a jack mechanism and a chain. One end of the chain is secured to the vehicle. The chain then passes through the jack and is secured on the other end to a special stake driven into the ground. Although this system appears workable, the use of the stake makes it impractical in many locations. In hard ground, a sledgehammer is needed to drive the stake. In soft ground, the stake may not hold and in frozen ground the stake is useless. U.S. Pat. No. 5,072,962 to Webb teaches a power winch that is mounted to a tube. The tube is designed to fit into a box receiver. In this way, the winch can be placed on the front or rear of a vehicle and can be moved as needed. The device also teaches having one end of the tube for a second box receiver so that a ball hitch can be added to the system for hauling a trailer. Although this device is the ideal, it is a powered winch. These winches can be expensive and may not be economical if needed only occasionally. U.S. Pat. No. 5,593,139 to Julian discloses a hand winch mounted to a tube for installation in a receiver box. Although this is a lower cost alternative to the powered winch, it is also something that may not be used very often. This, the owner bears the expense of a tool that is seldom used U.S. Pat. No. 5,913,507 disclosed s tube mounted hand winch that is designed to fit over a hitch ball. In this design, a telescoping leg is installed at the outer end of the tube. Once again, this is a useful tool, but is not economical of used infrequently. Moreover, the design requires the use of the rear leg, which complicates matters. Finally, U.S. Pat. No. 6,138,992 discloses a winch pulley that is punted in a receiver box. This pulley is used in conjunction with a standard mounted truck winch. The pulley is used to redirect the pull of the winch in any desired direction. This is also a useful tool, but only if one has a winch in place. Thus, unless a winch will be used often, a user must bear the expense of a winch and the pulley system for only occasional use.

BRIEF DESCRIPTION OF THE INVENTION

The instant invention overcomes all of these difficulties. It eliminates the need for a hand or power winch by using a vehicle jack-something that may be also seldom used, but is found as standard equipment on the vehicle. As such, the need for an expensive winch is eliminated. Moreover, because the system is affordable, the user may find that jobs that may have been avoided or done with other means can be done more easily with the instant invention at no additional cost or inconvenience. The invention is a frame assembly that fits into the hitch receiver box found on many trucks. The typical receiver box is a square tube that has holes drilled in it to receive a locking pin. The box is designed to hold a smaller square accessory tube. The accessory tube is placed in the receiver box and is secured with the locking-pin. The outer end of the accessory tube holds useful equipment. Most often, this equipment consists of a hitch ball and accessories so that a trailer can be attached for hauling items such as boats or building materials or recreational camping trailers.

In the instant invention the accessory tube is used to hold the workings of a manual winch. A reinforced vertical plate is attached to the outer end of the accessory tube. The vertical plate has a series of lugs attached to the top sides of the plate. A pulley is mounted below the lugs. Finally, a hole is formed in the plate at the bottom. The lugs are designed to hold the bottom of a standard car jack, which is modified for this purpose. The car jack has a lift plate and is operated by a handle. The lift plate has an eye mounted to it and a length of wire rope is attached to the eye. The wire rope passes around the pulley. A hook is attached to the other end of the wire rope.

To use the winch, first place the accessory tube in the receiver box and secure it in place. Next place the jack in the lugs and attach the wire rope to the eye. Then take the other end of the wire rope and secure it to an anchor chain, which is secured to a substantial object, such as a tree. Then, the user operates the jack. As the jack pulls on the wire rope, it acts to move the vehicle. In this case, the vehicle moves backwards. If the travel length of the jack is sufficient to extricate the vehicle, the operation is then complete and the device can be removed. If more pull is needed, the anchor chain is fed through the hole in the plate to hold the vehicle in place while the hook-end of the wire rope is reattached to the chain closer to the anchor. Once reset, the jack can be used to pull the vehicle back through another jack length. This process can be repeated as needed until the vehicle is freed or until the item to be moved is at the desired location, or a new anchor needs to be established.

DETAILED DESCRIPTION OF THE INVENTION

Figure 1:
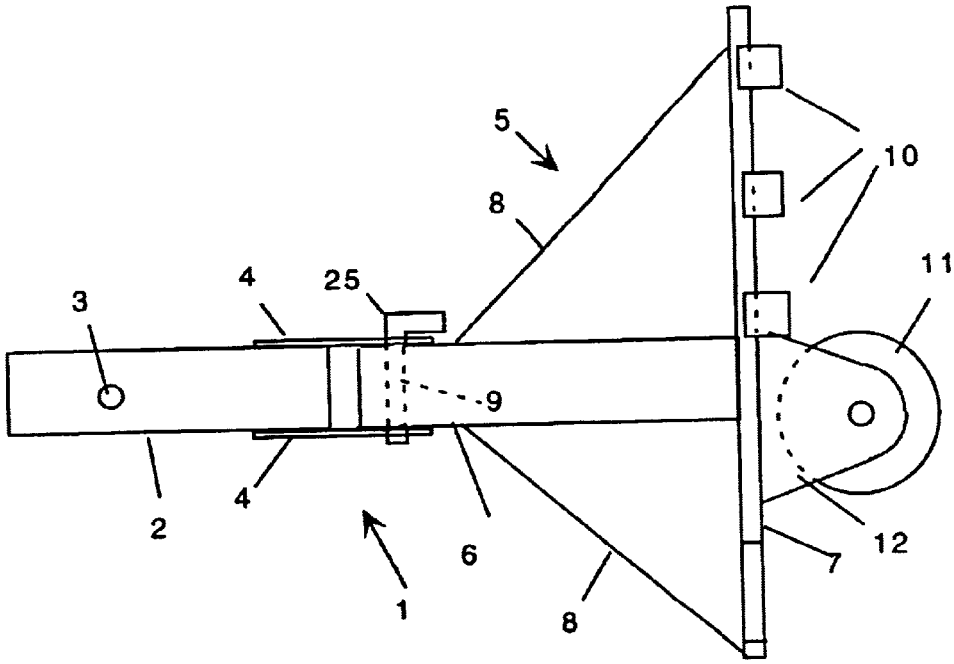
FIG. 1 is a side view of the invention.

Referring now to FIG. 1, a side view of the invention 1 is shown. The invention has three main components. First is a rear connection tube 2 that has a hole 3 for a pin 25 (see FIG. 5) to connect the connection tube 2 to a standard hitch receiver box on a truck. At the other end of the connection tube 2 are a pair of plates 4. The plates 4 are welded to the top and bottom of the connection tube as shown. The use of these plates is discussed below.

Figure 4:
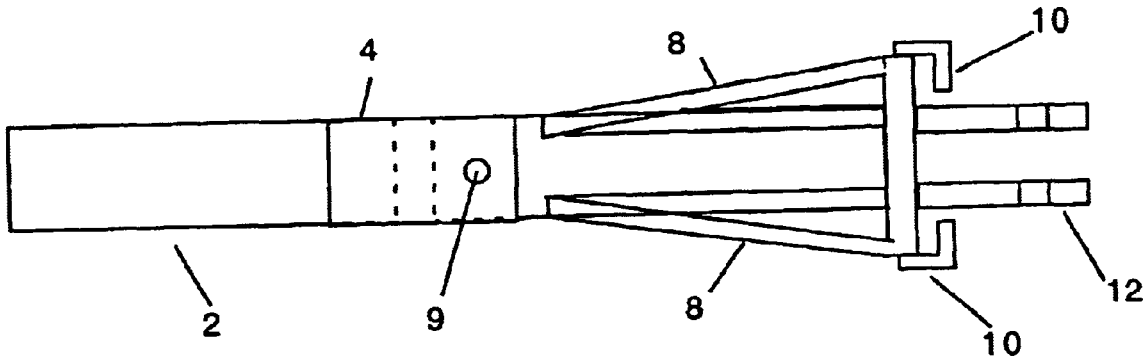
FIG. 4 is a top view of the invention.

The second is a jack support member 5. The jack support member 5 has a face plate 7 that is welded to an extension tube 6. Reinforcing gussets 8 are welded onto the back of the faceplate for further strength. At the top of the faceplate are six lugs 10. FIG. 4 shows these lugs from the top. The lugs have a space between the lugs and the faceplate as shown in FIG. 4. This use of these lugs is discussed further below.

Figure 2:
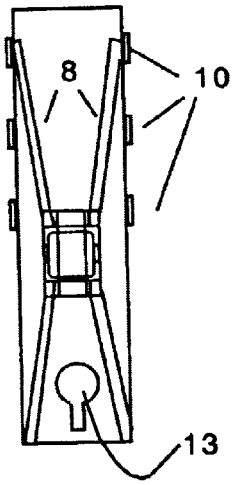
FIG. 2 is a rear view of the invention in reduced scale.
Figure 3:
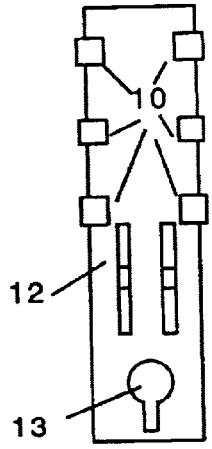
FIG. 3 is a front view of the invention in reduced scale.

Below the lugs 10 is a pulley 11 that is held by two brackets 12. The brackets are welded to the faceplate as shown. Below the pulley is a key hole 13 (see FIGS. 2 and 3). The keyhole is used with a security chain, as discussed below.

The faceplate a 7 has an extension-tube 6 that extends back from the faceplate as shown. This tube has a vertical hole 9 near the back that allows it to attach the tube to the plates 4 on the rear connection tube 2. A second pin 25 is used to secure the extension tube 6 to the plates 4. This connection system allows the jack support member 5 to be rotated within the plates as desired, for the best operating angle. Note also, it is possible to provide a second hole, perpendicular to the first hole so that the winch base 5 can be rotated 90 degrees before placing it between the plates. This construction also allows the rotated winch base to be positioned at an angle with respect to the winch base as well.

Figure 5:
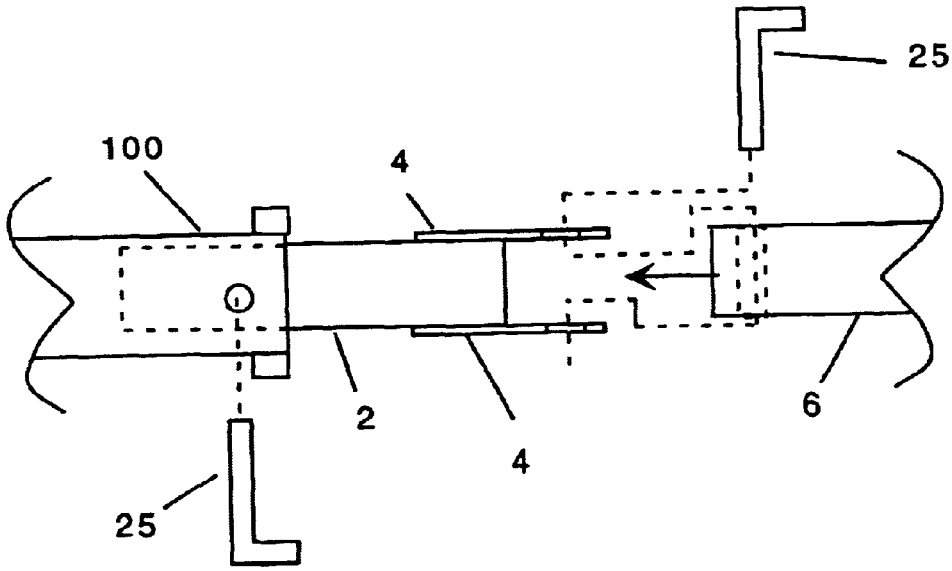
FIG. 5 is a detail view of the invention installed in a box receiver.

FIG. 5 shows the connection tube 2 installed in a reciever box 100. The pin 25 is used to secure the connection tube in place in a manner common to the art.

Note also that FIG. 5 shows the plates 4 prior to engaging the extension tube 6. This view also shows the route of the pin 25 that is used to secure the extension tube 6 to the plates 4. This is the preferred embodiment. Of course, the plates and connection tube can be eliminated and the extension tube can be lengthened if desired. This in not preferred because it limits the ability to turn the device to a particular angle.

Figure 6:
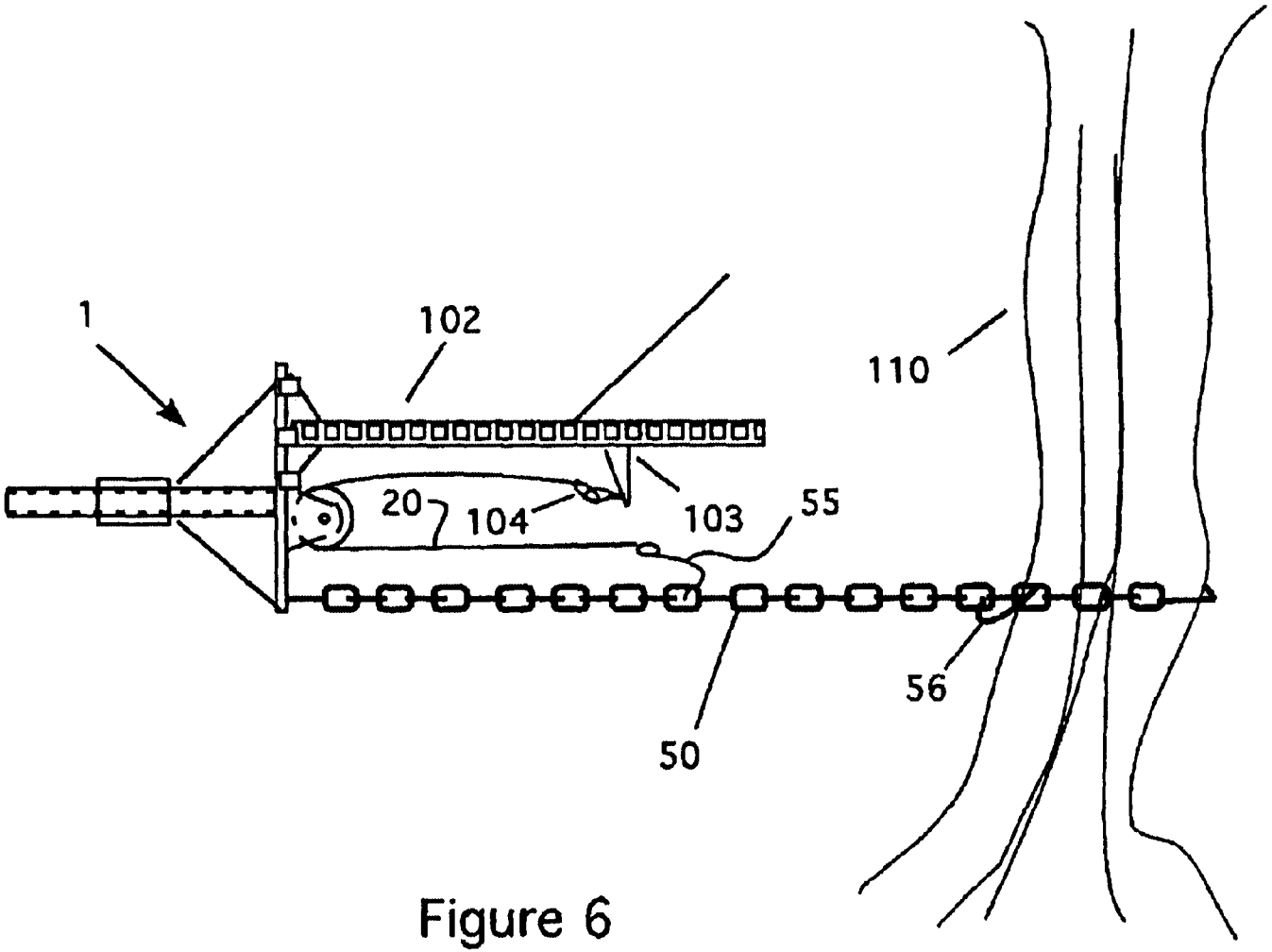
FIG. 6 is a detail view of the device installed for use with a jack in place and a wire rope and chain secured around a tree.

The third element of this device is a car jack 102. FIG. 6 shows the device in operation. The device is set in a vehicle (not shown). The rectangular base of a standard car jack 102 is placed in the space between the lugs and the faceplate. The lugs then hold the jack in place. The jack has a lift plate 103 that is fitted with an eye 104. A length of wire rope 20 is secured to the eye 104, passed through the pulley and extended out. A hook 55, shackle, or similar type device is then used to secure the wire rope around to the anchor chain 50, which is attached to a fixed object, such as a tree 110. The chain is secured by a hook 56 or similar fastener. The jack can then be operated. As the lift plate moves from the base to the top of the jack, the wire rope is pulled, which causes the vehicle to be pulled backwards towards the fixed object. When the lift plate has reached the top of the jack, it maybe necessary to pull the vehicle further. If this is the case, a chain 50 is hooked to the keyhole in the bottom of the faceplate to form a solid attachment from the hitch to the vehicle. Once the chain is taught and secure, the jack can be released and the lift plate lowered to the base of the jack. The jack can then be operated to once again pull the vehicle backwards. This operation can be repeated as needed until the vehicle is in a desired location.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A winch base comprising:

a) a tube, having a proximate end and a distal end;

b) a means for mounting said tube in a truck receiver box;

c) vertical faceplate fixedly attached to the proximate end of said tube d) a means for releasably securing a base of a car jack such that a car jack extends substantially perpendicular and is fixedly secured to said vertical faceplate and;

e) a pulley, rotatably attached to vertical faceplate.

2. The winch base of claim 1 wherein the faceplate has a mounting hole formed thereon.

3. The winch base of claim 1 wherein the means for releasably securing a base of a car jack comprise a plurality of lugs fixedly attached to said vertical faceplate.

4. The winch base of claim 1 wherein means for mounting said tube in a truck receiver box comprise a mounting hole formed in the distal end of said tube.

5. The winch base of claim 1 wherein means for mounting said tube in a truck receiver box comprise:

a) a second tube, having a proximate end and a distal end, whereby the distal end of the second tube has a means for attacking said second tube to a box receiver;

b) a pair of plates fixedly attached to the proximate end of said second tube; and c) a means for removably securing said tube between said pair of plates.

6. A winch base comprising:

a) a first tube, having a proximate end and a distal end;

b) a vertical faceplate fixedly attached to the proximate end of said first tube;

d) a means for releasably securing a base of a car jack extends substantially perpendicular and is fixedly secured to said vertical faceplate.

e) a pulley, rotatably attached to vertical faceplate; and such that a car jack extends substantially perpendicular and is fixedly secured to said vertical faceplate; and f) a means for securing a length of chain to said vertical faceplate.

7. The winch base of claim 6 wherein the means for releasably securing a base of a car jack comprise a plurality of lugs fixedly attached to said vertical faceplate.

8. The winch base of claim 6 further comprising:

a second tube, having a proximate end and a distal end, whereby the distal end of the second tube has a means for attaching said second tube to a box receiver;

b) a pair of plates fixedly attached to the proximate end of said second tube; and c) a means for removably securing said tube between said pair of plates.

9. The winch base of claim 6 further comprising:

a) said car jack having a lift plate;

b) an eye attached to said lift plate;

c) a length of chain;

d) a length of wire rope, said length of wire rope having a first end and a second end, whereby the first end of said length of wire rope is attached to the eye, and the second end of the length of wire rope is attached to the length of chain; and e) a means for temporarily securing the length of chain to a fixed object.

10. A method of winching a vehicle comprising the steps of:

a) affixing a winch base, having a tube, having a proximate end and a distal end; a means for mounting said tube in a truck receiver box a vertical faceplate fixedly attached to the proximate end of said tube; a means for securing a base of a car jack such that a car jack extends substantially perpendicular and is fixedly secured to said vertical faceplate; and a pulley, rotatably attached to said faceplate in a truck reciever box;

b) placing a base of a car jack in said means for securing a base of a car jack; attaching one end of a length of wire rope to said car jack;

c) running the length of said wire rope through the pulley;

d) attaching a second end of said length of wire rope to length of chain;

e) attaching the length of chain to a fixed object; and f) operating said car jack, causing said length of wire rope to move said vehicle.

11. The method of claim 10 wherein said vertical faceplate mounting hole formed therein.

12. The method for claim 11 further comprising the steps of:

a) securing one end of the lend of chain in said mounting hole of said vertical faceplate.

b) tensioning the length of chain;

c) reversing said car jack to relieve tension on said length of wire rope;

d) resetting said car jack for a second jacking operation; and e) operating said jack causing said vehicle to move an additional distance.

13. The method of claim 10 wherein steps are repeated as needed to move said vehicle a desired distance.

14. The method of claim 10 wherein the a means for mounting said tube in a truck receiver box comprise:

a) a second tube, having a proximate end and a distal end, whereby the distal end of the second tube has a means for attaching said second tube to a box receiver;

b) a pair of plates fixedly attached to the proximate end of said second c) a means for removably securing said tube between said pair of plates.

15. The method of claim 14 wherein the step of affixing the winch base to a truck receiver comprises the steps of a) attaching a second tube, having a proximate end and a distal end to a box receiver;

b) positioning the tube between the pair of plates; and c) placing a pin through said pair of plates and said tune tube to releasably secure said tube to said pair of plates.

16. The method of claim 15 further comprising the steps of:

a) prior to attaching said length wire rope to said length of chain, positioning said winch base at a desired angle with respect to said receiver box.

* * * * *